US006591610B2

(12) United States Patent
Yazawa et al.

(10) Patent No.: US 6,591,610 B2
(45) Date of Patent: Jul. 15, 2003

(54) CONVERTING DISSIPATED HEAT TO WORK ENERGY USING A THERMO-ACOUSTIC GENERATOR

(75) Inventors: Kazuaki Yazawa, Chiba (JP); Avram Bar-Cohen, St. Louis Park, MN (US)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/994,170

(22) Filed: Nov. 26, 2001

(65) Prior Publication Data

US 2003/0097838 A1 May 29, 2003

(51) Int. Cl.[7] ..... F01B 29/10
(52) U.S. Cl. ..... 60/527; 337/140
(58) Field of Search ..... 60/527, 528; 337/140

(56) References Cited

U.S. PATENT DOCUMENTS 4,553,393 A * 11/1985 Ruoff ..... 60/528
4,772,807 A * 9/1988 Bouvot ..... 307/119
5,410,290 A * 4/1995 Cho ..... 337/140

* cited by examiner

*Primary Examiner*—Hoang Nguyen
(74) *Attorney, Agent, or Firm*—Sonnenschein, Nath & Rosenthal

(57) ABSTRACT

An apparatus and method for converting waste heat from a low temperature heat source, such as an electrical component, to work energy and for efficiently transferring unconverted or remaining waste heat away from the heat source. The apparatus includes a chamber having a first location adapted to receive heat from the heat source, and a second location adapted to dissipate heat transferred via an acoustic wave in the chamber. The acoustic wave may be produced by a first vibration member coupled to an interior surface of the chamber and disposed at an end of the chamber, where the first vibration member is adapted to vibrate at a resonant frequency of the chamber. Alternatively, a first and a second vibration member that are both adapted to vibrate at the resonant frequency of the chamber may be disposed equidistant from opposing ends of the chamber to produce a standing acoustic wave within the chamber. Each vibration member is coupled to a respective transducer that senses a deformation of the respective vibration member and generates a proportional AC voltage which may be stored in an electrical storage for supply to an external load.

43 Claims, 6 Drawing Sheets

CONVERTING DISSIPATED HEAT TO WORK ENERGY USING A THERMO-ACOUSTIC GENERATOR

BACKGROUND OF THE INVENTION

The present invention generally relates to methods and systems for converting heat energy to other forms of energy. In particular, the invention relates to devices for dissipating heat generated by electrical components.

Electrical components, such as integrated circuits, including a central processor unit (CPU) for a computer, and operating in close proximity in an enclosed electronic apparatus, produce heat. To prevent thermal failure of one of the electrical components in the enclosed electronic apparatus this heat needs to be dissipated. Enclosed electronic apparatuses are common and typically include personal computers, display monitors, computer peripherals, television sets, handheld personal digital assistants (PDAs), cellular phones, facsimile machines, video cassette recorders (VCRs), digital versatile disc (DVD) players, and audio systems.

Thermal management of the electronic components in the enclosed electronic apparatus is used to prevent an enclosed electronic apparatus from failing or to extend the useful life of the enclosed electronic apparatus. For instance, a typical CPU operating in a personal computer may operate at a temperature of 70° C. without experiencing a thermal failure. Heat generated by a typical CPU, however, often reaches a temperature of 100° C. Conventional methods for thermal management of the enclosed electronic apparatus provide that a high heat producing electronic component be attached to a heat sink and positioned within the enclosure of the electronic apparatus so that either air convection or forced air dissipates the heat from the enclosed electronic apparatus. These conventional methods expel the heat as waste energy.

Systems have been developed to recover electrical energy from waste heat in solar-concentrator heated fluids, and geothermal sources. These systems, however, require that the waste heat be between 100° C. to 200° C. for a practical thermoelectric conversion efficiency (i.e., recover and convert enough heat energy to compensate for system power consumption). Prior efforts to produce economical electrical power from lower temperature sources (primarily heat sources at less that 100° C. or 70° C. to 100° C. ) have generally proven unsuccessful.

SUMMARY OF THE INVENTION

The present invention provides an apparatus and method for dissipating heat from a relatively low temperature heat source, such as an electrical component, and converting the dissipated heat to work energy, such as electricity.

In an embodiment, an apparatus includes a closed system chamber that has a first location adapted to receive heat from the heat source, and a second location adapted to dissipate heat away from the heat source. The apparatus may include a means to draw heat from the chamber, such as a heat exchanger that is thermally connected to the second location of the chamber. The apparatus also includes a fluid, such as a gas or liquid, that substantially fills the chamber. In addition, the apparatus includes a first energy converter located within the chamber that is in thermal communication with the first and second locations of the chamber via the fluid. The first energy converter may produce an acoustic wave, preferably a standing acoustic wave, in the chamber to transport heat from the first location to the second location and out to the ambient. In addition, the first energy converter may receive heat and convert at least a portion of the heat to electrical energy.

In an embodiment, the first energy converter preferably includes a first vibration member and a transducer that is operably coupled to the first vibration member. The first vibration member is adapted to vibrate in response to an electrical potential applied to the first vibration member and in response to a pressure change in the fluid. The first vibration member is also preferably adapted to vibrate at a predetermined resonant frequency of the chamber so that an acoustic or sound wave may be produced in the chamber to transport heat from the first location to the second location. The first vibration member is preferably disposed in proximity to an end of the chamber to prevent the formation of harmonics that may attenuate the acoustic wave. The transducer may be any electrical generator, such as a piezoelectric film, that is adapted to generate electricity from the vibration of the first vibration member.

The apparatus may include an electrical storage that is electrically connected to the transducer to capture and store the generated electricity. The apparatus may also include a power supply electrically connected to the first vibration member to selectively prompt the first vibration member to vibrate.

In an embodiment, an apparatus such as previously described further includes a second energy converter that has a second vibration member. The second energy converter may have a and a second transducer operably coupled to the second vibration member. Both the first and second vibration members are each adapted to vibrate in response to a pressure change in a fluid within the chamber and to a potential applied to the respective vibration member. In addition, the first and second vibration members are each adapted to vibrate at the predetermined resonant frequency of the chamber. The first vibration member and the second vibration member are preferably disposed equidistant from opposing ends of the chamber to produce a standing acoustic wave that extends the resonant length of the chamber that effectively transports heat from the first location to the second location of the chamber and out to the ambient.

In an embodiment of the present invention, a method for producing electrical energy is disclosed. The method generates a standing acoustical wave in a chamber having a predetermined resonant frequency in response to the vibration of a first and a second vibration member disposed equidistant from opposing ends of the chamber, receives heat through a first location of the chamber; generates in proximity of the first location a first pressure change associated with the transfer of a first portion of the received heat by the standing acoustic wave in the chamber; vibrates a first vibration member disposed within the chamber in response to the first pressure change; and generates a first voltage in response to the vibration of the first vibration member.

In another embodiment, the method also generates in proximity of the second location a second pressure change associated with the transfer of a second portion of the received heat by the standing acoustic wave in the chamber; vibrates a second vibration member disposed within the chamber in response to the second pressure change; generates a second voltage in response to the vibration of the second vibration member; and dissipates a third portion of the heat transferred via the standing acoustic wave at a second location within the chamber.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components of the figures are not necessarily to scale, emphasis instead being placed upon illustrating the principals of the invention. Moreover, in the figures, like reference numerals designate corresponding parts throughout the different views.

DETAILED DESCRIPTION OF THE PRESENTLY PREFERRED EMBODIMENTS

As discussed above, there is provided an apparatus and method for converting waste heat from a low temperature heat source, such as an electrical component, to work energy and for efficiently transferring unconverted or remaining waste heat away from the heat source.

Figure 1:
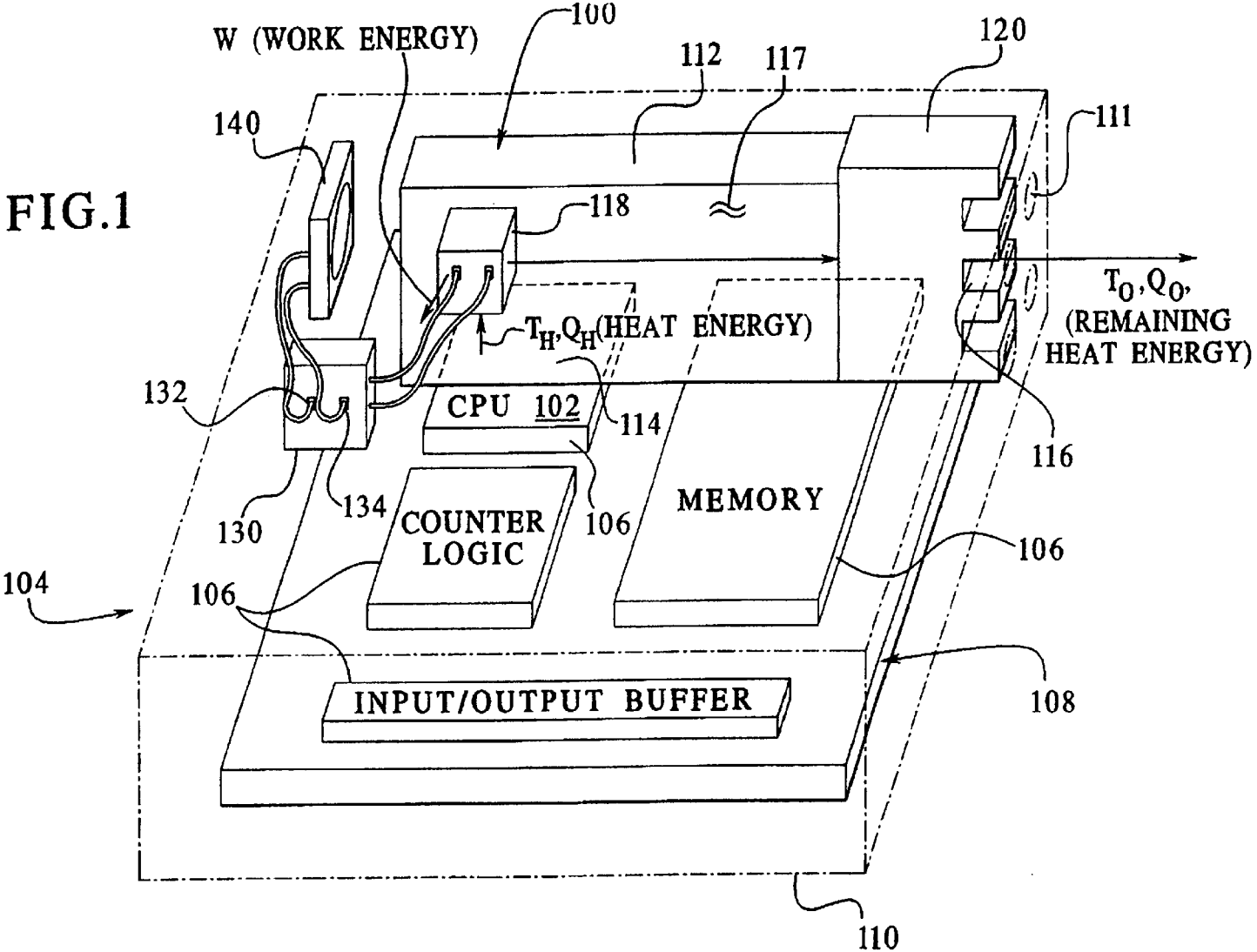
FIG. 1 depicts in perspective view of an exemplary thermo-acoustic generator in accordance with the present invention.

FIG. 1 illustrates a perspective view of an exemplary thermo-acoustic generator 100 for converting heat energy or waste heat to work energy in accordance with the invention. In FIG. 1, the thermo-acoustic generator 100 is thermally connected to an electrical component 102 heat source of an electrical device 104. The electrical device 104 may be a personal computer, VCR, DVD, or other electronic apparatus.

Electrical component 102 may be one of a group of electrical components 106 that are part of the electrical device 104. Electrical components 106 may be any device that gives off heat when operating or when power is supplied to the electrical components. Electrical components 106 are low temperature heat sources that emit heat at a temperature up to 150° C. before thermal breakdown. As illustrated in FIG. 1, the electrical device 104 also includes a platform 108, such as a printed circuit board, that supports and provides electrical interconnections between the electrical components 106. The electrical device 104 may also include an enclosure 110 or housing that substantially surrounds the platform 108 and the electrical components 106. The enclosure 110 may also cover at least a portion of the thermo-electric generator 100. The enclosure 110 may have a vent 111 or hole for heated air within the electrical device 104 to exit to ambient outside the electrical device 104. Without the present invention, the enclosure 110 retains or inhibits heat generated by the electrical components 106 from being transferred out of the electrical device 104.

As shown in FIG. 1, the thermo-acoustic generator 100 includes a chamber 112 that has a first location 114 adapted to receive heat, and a second location 116 adapted to dissipate heat. The thermo-acoustic generator 100 also includes a fluid 117 that substantially fills the chamber 112 and which is thermally conductive or yields high heat transfer (e.g. yields high heat transfer coefficients). The thermo-acoustic generator 100 also includes an energy converter 118 that is located within the chamber 112 and that is in thermal communication with the first location 114 and the second location 116 via the fluid 117.

In general, the thermo-acoustic generator 100 receives heat energy ($Q_H$) through the first location 114. When receiving heat energy ($Q_H$), the first location 114 has a first temperature ($T_H$) that may be as high as 150 degrees Celsius while the second location 116 has a second temperature $T_O$ that may be close room or ambient temperature. The first temperature and the second temperature produce a temperature gradient in the chamber 112. The energy converter 118 produces an acoustical or sound wave within the chamber 112 when presented with an electrical bias as explained. As known to one skilled in the art, an acoustical wave may transport heat. In response to the temperature gradient, the acoustical wave transports heat from the first location 114 to the energy converter 118. The energy converter 118 converts at least a portion of the received heat energy ($Q_H$) to acoustic energy (i.e., sound pressure), and converts at least a portion of the acoustic energy to work energy (W), such as electrical energy as disclosed herein. Acoustic energy that is not converted to work energy (W) increases a magnitude of the acoustical wave produced within the chamber 112. Thus, the acoustical wave within the chamber 112 carries or transfers a portion of the heat ("remaining heat energy ($Q_O$)") that is not converted to acoustic energy from the first location 114 to the second location 116 so that the remaining heat $Q_O$ may be transferred out of the thermo-acoustic generator 100, and thus out of the electrical device 104, to the ambient. The acoustic wave is preferably a standing acoustic wave, which as discussed herein increases the efficiency of converting heat to work energy while transferring the remaining heat $Q_O$ to the second location 116.

To facilitate drawing the remaining heat $Q_O$ out of thermo-acoustic generator 100 to the ambient, the thermo-acoustic generator 100 may also include a standard heat exchanger 120, such as a heat sink, which may be any device used to transfer heat from a first fluid on one side of a barrier to a second fluid on another side of a barrier without bringing the first and second fluids into direct contact. The heat exchanger 120 is thermally connected to the thermo-acoustic generator 100 at the second location 114.

The electrical device 104 may also include an electrical storage 130, such as a capacitor or battery, that is adapted to store an electrical charge. The thermo-acoustic generator 100 may transfer the work energy (W) in the form of electricity to the electrical storage 130. The electrical storage 130 may be operably connected to a load device 140 to provide power to the load device 140. The load device 140 is preferably a box fan or other cooling apparatus that would utilize the power from the electrical storage 130 to further dissipate heat out of the electrical device 104.

Figure 2:
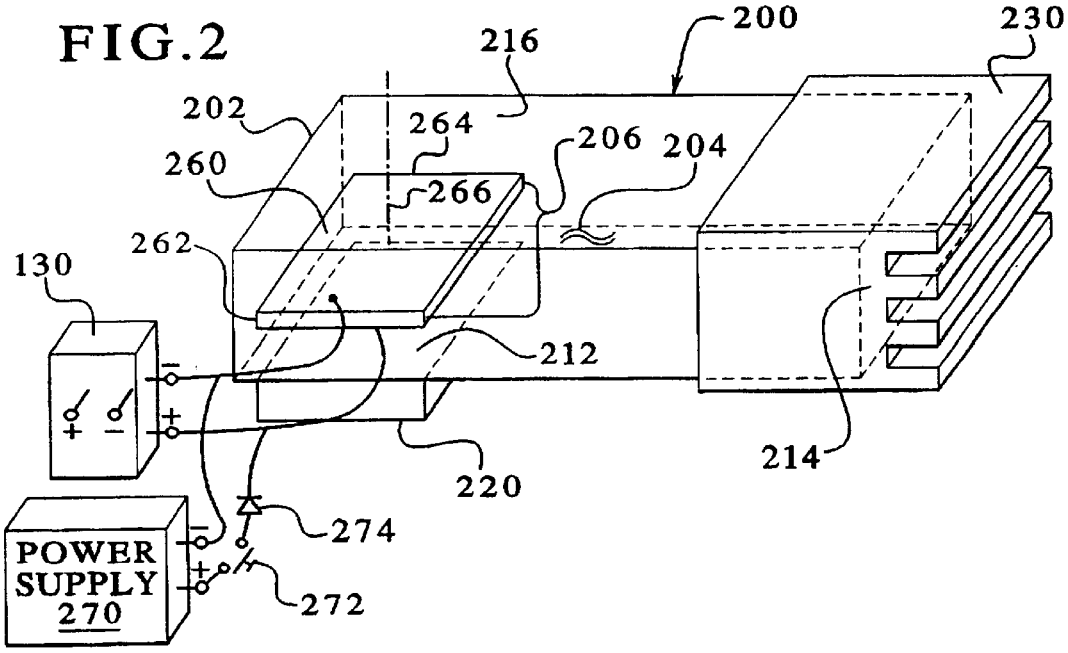
FIG. 2 depicts in perspective view an exemplary thermo-acoustic generator embodying principles of the present invention.

FIG. 2 depicts a perspective view of one embodiment of thermo-acoustic generator 200 that produces work energy in the form of electricity from heat. The thermo-acoustic generator 200 includes a chamber 202, a fluid 204 located within the chamber 202, and an energy converter 206.

The chamber 202 defines a closed system that is an isolated system having no direct interaction with the environment outside the chamber 202. As one skilled in the art may appreciate, the closed system of the chamber 202 has a thermal and acoustic behavior that is entirely explainable from within the chamber 202. However, it is contemplated that the chamber 202 may have at least one small opening (not shown in the figures) that allows an interaction with the environment, such as ambient air. The at least one small opening does not substantially effect the operation of the chamber 202 as a closed system in accordance with the present invention. An acoustical wave produced in the chamber 202 in accordance with the present invention continues to oscillate or travel back and forth in the chamber 202. Thus, the closed system of the chamber 202 advantageously prevents loss of acoustical pressure to the ambient before it can be converted to work energy. In other words, acoustical pressure produced by the energy converter 206 but not yet converted to work energy (i.e., acoustical pressure that increases the magnitude of the acoustical wave) can be subsequently converted to work energy by the energy converter 206 as the acoustical wave travels back and forth in the chamber 202.

The closed system of the chamber 202 is designed so that the chamber 202 has a resonant length and a predetermined resonant frequency. When operating, the thermo-acoustic generator 200 may produce a standing acoustic wave approximately equal to the predetermined resonant frequency. The predetermined resonant frequency of the chamber 202 is characterized as $\omega=2\pi s/L$, where s is the speed of sound in m/sec, and L is the resonate length of the chamber 202 in meters. The standing acoustic wave is preferably a sinusoidal wave that oscillates high and low during one acoustic cycle within the chamber 202. To produce the standing acoustic wave, the chamber 202 may be box-shaped as shown in FIG. 2. However, the chamber 202 may also be cylindrical, spherical, or non-symmetrical in shape.

The chamber 202 has a first location 212 adapted to receive heat (i.e., corresponding to the first location 114 of the thermo-acoustic generator 100), a second location 214 adapted to dissipate heat (i.e., corresponding to the second location 116 of the thermo-acoustic generator 100), and an interior surface 216. Thus, the behavior of the chamber 202 as a closed system is effected by heat at the first and second locations 212 and 214 of the chamber 202. The first location 212 and the second location 214 are preferably adjacent to opposite ends of the chamber 202. The first location 212 is adjacent to a heat source 220 (i.e., the electrical component 102). The first location 212 has an area that is preferably the same size as the heat source 220 and is aligned with the heat source 220 to increase the heat received through the first location 212. The second location 214 may be adjacent to a heat exchanger 230, which has at least one side thermally connected to the chamber 202. The second location of the chamber 214 has an area that is not larger than the at least one side of the heat exchanger 230. The second location is preferably covered by the at least one side of the heat exchanger 230 to increase the dissipation of heat that is not converted to electrical energy as described herein.

Figure 3A:
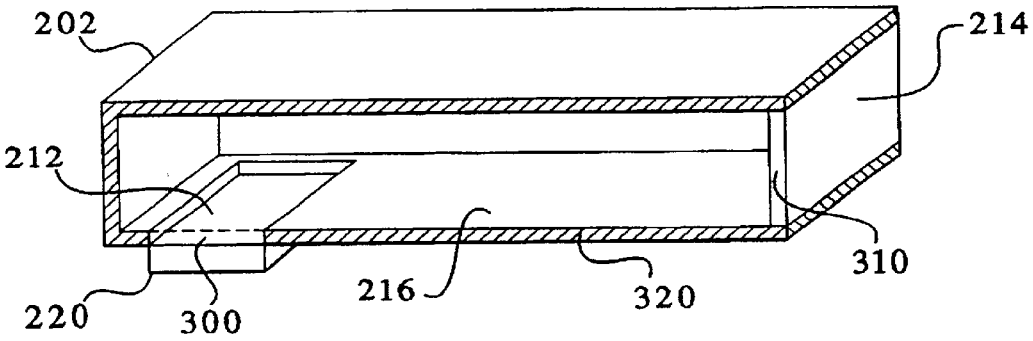
FIG. 3A depicts in perspective view an exemplary chamber of the thermo-acoustic generator in FIG. 2.

In FIG. 3A, an exemplary perspective view of the chamber 202 of the thermo-acoustic generator 200 is shown. The chamber 202 has a first wall portion 300 associated with the first location 212, a second wall portion 310 associated with the second location 214, and a third wall portion 320 defined by the interior surface 216 exclusive of the first and second locations 212 and 214. The first and second wall portions 300 and 310 comprise conductive material, such as metal, to facilitate receiving and dissipating heat through the chamber 202. The first and second wall portions 300 and 310 may be of different sizes. The third wall portion 320 preferably comprises an insulation material to channel heat, received through the first location 212, to the second location 214.

Figure 3B:
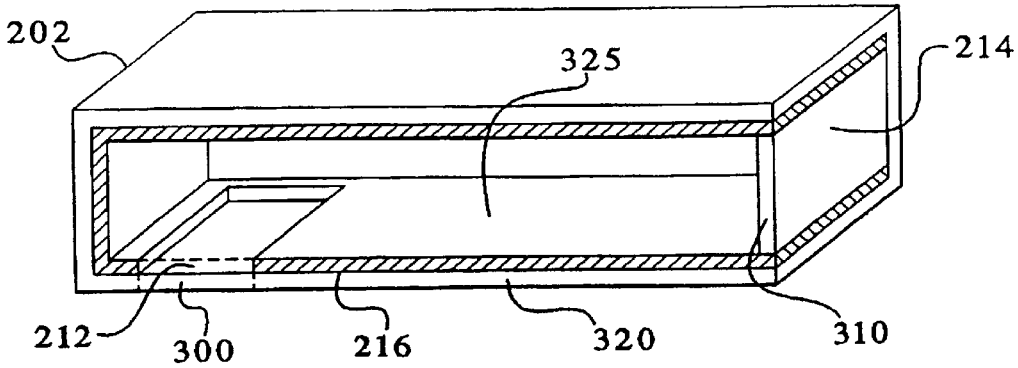
FIG. 3B depicts in perspective view an exemplary chamber of the thermo-acoustic generator in FIG. 2.

In an alternative implementation shown in FIG. 3B, the interior surface 216 of the chamber 202 associated with the third wall portion 320 is substantially covered with an insulating material 325 to channel heat, received through the first location 212, to the second location 214. In this implementation, the first wall portion 300 may be the same size as and may cover the electrical component 220 to increase the amount of heat that the chamber 202 receives through the first location 212.

Returning to FIG. 2, the fluid 204 within the chamber 202 may be a gas, such as air, nitrogen, helium or other common gas that remains in a gaseous state at room temperature and at room pressure. The fluid 240 may also be any known liquid that remains in a liquid state at room temperature and room pressure. The fluid 240 is preferably non-corrosive on most metals and on plastic, which may be used as an insulator within the chamber 202. The fluid 240 substantially fills a volume defined by the interior surface 216 of the chamber 202. When a standing acoustic wave is present in the chamber 202, a parcel of the fluid 240 in the acoustic wave compresses (i.e., the parcel in the fluid 240 is heated) in the chamber 202 in proximity to the first location 212 and expands (i.e., the parcel in the fluid 240 is cooled) in the chamber 202 in proximity to the second location 214 as the standing acoustic wave oscillates in the chamber 202. Thus, heat energy is transported away from the first location 212 and to the second location 214. In addition, the cyclical compression and expansion of a parcel of the fluid 240 results in the energy converter 206 sensing a periodic pressure change (i.e., temperature gradient across the energy converter 206) associated with the heat transfer which the energy converter 206 may convert to work energy, such as electricity, as described in reference to FIG. 2.

As shown in FIG. 2, the energy converter 206 may include a vibration member 260 that has a first end 262, a second end 264, and a center axis 266. Each end 262 and 264 of the vibration member 260 is coupled to the interior surface 216 of the chamber 202 so that the vibration member is free to vibrate about the center axis 266 in response to a bias means. The bias means may be a temperature difference or a pressure change in the chamber 202 caused by the expansion and compression of a parcel in the fluid 240 traveling in the acoustical wave. The bias means may also be an electrical potential present on the vibration member 260. The vibration member 260 may be square, rectangular, or circular in shape. The vibration member 260 is also of sufficient size to span a width of the chamber 202. The vibration member 260 may be a plate, membrane, or diaphragm that is adapted to be easily deformed by the bias means.

The vibration member 260 is also electrically connected to a power supply 270 that acts as an alternate bias means to initiate or maintain the vibration of the vibration member 260. The power supply 270 may be any standard or commercial power supply, including a standard battery that is capable of supplying a sufficient electrical potential to bias the vibration member 260. A switch 272, which may be associated with a power-on switch for system 100 (not shown in figures), provides a momentary connection to complete a signal or a bias path between the vibration member 260 and the power supply 270. The diode 274 is a standard diode that permits current from the power supply 270 to pass to the vibration member 260 to bias the vibration member. The diode 271, however, prevents current associated with the operation of the vibration member 260 to be directed to the power supply 270.

The vibration member 260 also has a predetermined vibration frequency. The vibration member 260 vibrates at its predetermined vibration frequency in response to the bias means, resulting in an acoustic wave being generated in the chamber 202. During the operation of the thermo-acoustic generator 200, the vibration member 260 may continue to vibrate and generate the acoustic wave in the chamber 202 in response to the periodic pressure changes produced in the fluid 240 within the chamber 202 as a result of heat transfer from the first location 212 to the second location 214.

The vibration member 260 may be disposed within the chamber 202 at a position that limits the damping or attenuation of the acoustic wave due to a harmonic of the predetermined vibration frequency of the vibration member 260. As known to one skilled in the art, a harmonic is a multiple of a fundamental frequency such as the predetermined vibration frequency. The vibration member 260 is also preferably designed so that its predetermined vibration frequency matches the predetermined resonant frequency of the chamber 202 to limit the generation of a harmonic within the closed system of the chamber 202. In this implementation, the vibration member 260 has a magnitude of deformation, x. The magnitude of deformation, x, corresponds to the deformation of the vibration member 260 about the center axis 266. The magnitude of deformation, x, may be characterized as follows: $x=\delta\sin(\omega t)$, where $\omega$ is a constant corresponding to the vibration member 260, $\omega$ is the predetermined resonant frequency of the chamber 260 in radians, and t is the time in seconds. Thus, the vibration member 260 is disposed in proximity to one end of the chamber 202 to limit the generation of a harmonic in the chamber 202.

Figure 4:
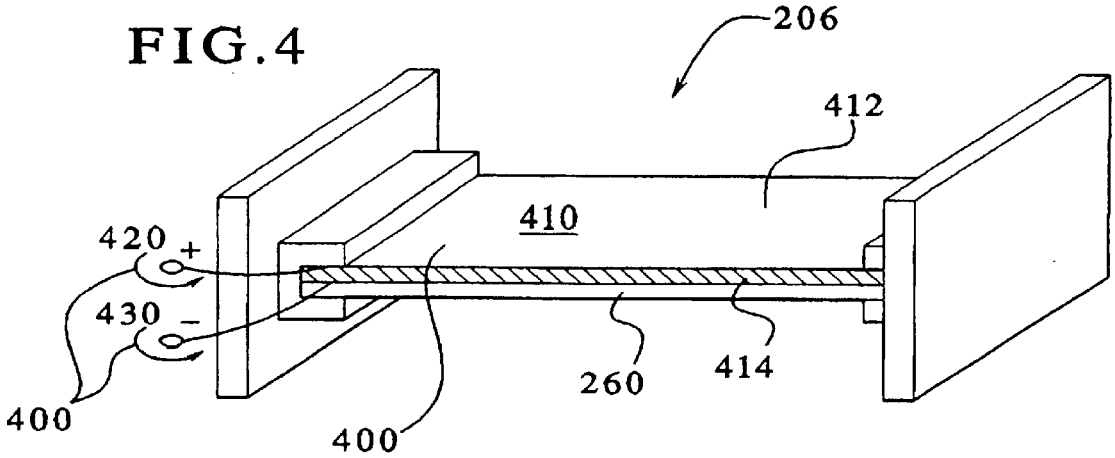
FIG. 4 depicts in perspective view an exemplary vibration member and associated transducer within the chamber of the thermo-acoustic generator in FIG. 2.

As shown in FIG. 4, the energy converter 206 may include a transducer 400 that is operationally coupled to or formed with the vibration member 260. A transducer may be any device or material that converts input energy of one form into output energy of another. The transducer 400 senses the vibration or reciprocating deformation (i.e., cyclical stress) of the vibration member 260 and produces an alternating current (AC) voltage that is proportional to the sensed reciprocating deformation. The transducer 400 works against or decreases the pressure change in the fluid 240 such that acoustical energy is converted to work energy (e.g., electricity).

In one implementation illustrated in FIG. 4, the transducer 400 includes a piezoelectric film 410 that is disposed on and electrically connected to the vibration member 260. The piezoelectric film 410 has a positive polarized surface 412 and a negative polarized surface 414. The transducer 400 also includes a positive electrode 420 that is electrically connected to the positive polarized surface 412 of the piezoelectric film 410, and a negative electrode 430 that is electrically connected to the negative polarized surface 414 of the piezoelectric film 410. The piezoelectric film 410 is flexible and deforms in association with the vibration member 260. A first deformation of the piezoelectric film 410 in the direction of the negative polarized surface 414 of the piezoelectric film 410 produces a negative voltage across the positive and negative electrodes 420 and 430 of the transducer 400 that is proportional to the first deformation. Similarly, a second deformation of the piezoelectric film 410 in the direction of the positive polarized surface 412 produces a positive voltage across the electrodes 420 and 430 of the transducer 400 that is proportional to the second deformation. Thus, when the vibration member 260 vibrates, the transducer 400 senses the first and second deformations of the vibration member 260 via the piezoelectric film 410, and produces an AC voltage across the positive and negative electrodes 420 and 430 of the transducer 400 that is proportional to the first and second deformations of the vibration member 260. Note that when the load device 140 depicted in FIG. 1 is electrically connected across the positive and negative electrodes 420 and 430 of the transducer 400, an electrical circuit is completed and the load device 140 receives from the transducer 400 an alternating current transporting a voltage proportional to the deformation of the vibration member 260. Thus, it is contemplated that the load device 140 may utilize the alternating current directly from the transducer 400 to obtain power.

It is contemplated that the vibration member 260 may include or be formed with the transducer 400 where the transducer 400 is a piezoelectric ceramic material. Thus, in response to the vibration or reciprocating deformation of the vibration member 260 (i.e., the piezoelectric material), an AC voltage may be produced across the positive and negative electrodes 420 and 430.

Figure 5:
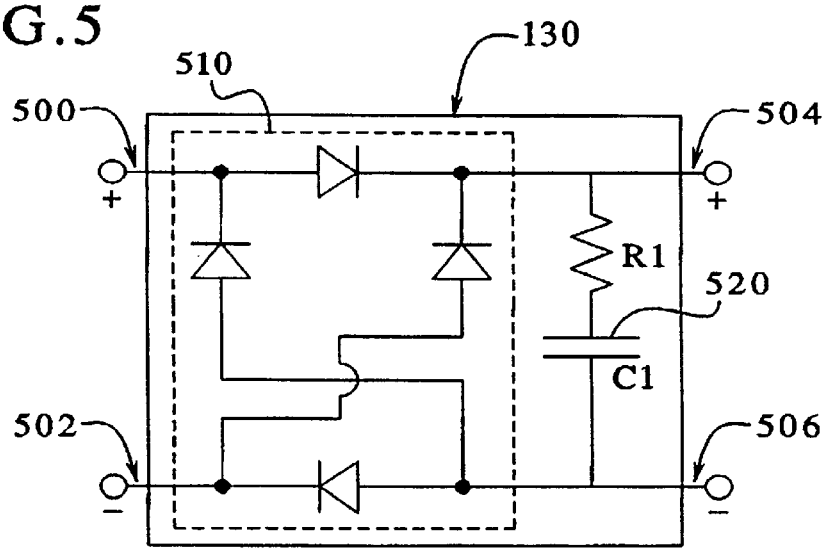
FIG. 5 depicts in schematic form an exemplary electrical storage embodying principles of the invention.

Turning to FIG. 5, the electrical storage 130 is shown in schematic form. The electrical storage 130 has a positive input 500 and a negative input 502 that are each electrically connected to a respective the positive and negative electrode 420,422 and 430,432 of the transducer 400. The electrical storage 130 receives and stores the voltage from the transducer 400. The electrical storage 130 also has a first and a second output 504 and 506 that can be connected to the load device 140 to provide power to the load device 140.

The electrical storage 130 includes a standard full-wave rectifier 510 and a capacitor 520 that is electrically connected to the full-wave rectifier 510. The full-wave rectifier 510 converts the asynchronous current received from the transducer 400 to a D.C. voltage that is stored in capacitor 320. The electrical storage 500 also includes a resistor 330 that controls the current flow to the load device that may be connected to the first and second outputs 506 and 508 of the electrical storage 300. It is contemplated that the electrical storage 130 may include any means known in the art for receiving an alternating current, transforming the alternating current to a direct current, and storing the voltage transported by the direct current.

Figure 6:
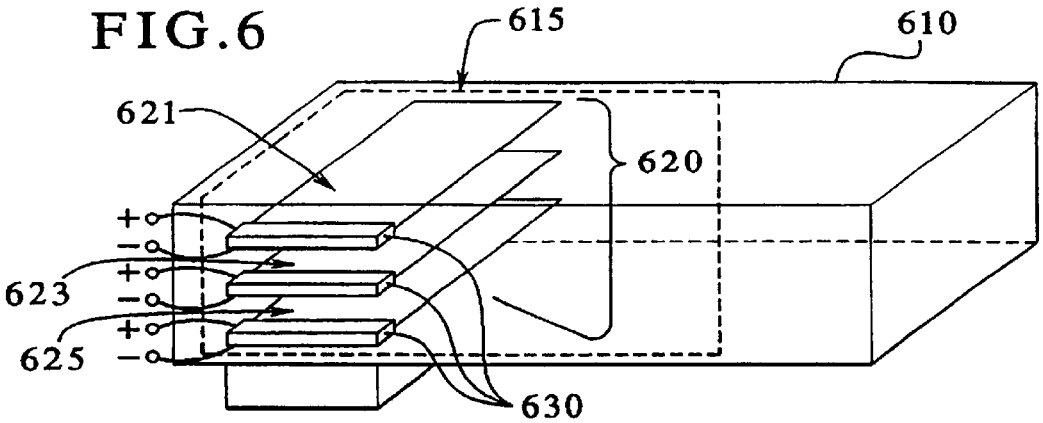
FIG. 6 depicts in perspective view a vibration stack in a chamber of another exemplary thermo-acoustic generator embodying principles of the present invention.

In FIG. 6, another implementation of a thermo-acoustic generator 600 embodying the principles of the present invention is shown. The thermo-acoustic generator 600 has a chamber 610 and an energy converter 615 within the chamber 610 that includes a vibration member 621. As shown in FIG. 6, the vibration member 621 (i.e., corresponds to vibration member 260) may be one of a group of vibration members (621, 623, and 625) in the energy converter 615. Each vibration member 621, 623, and 625 is substantially aligned vertically to form a vibration stack 620 within the energy converter 615. Each vibration member in the vibration stack 620 is electrically connected to a respective one of a group of transducers 630. Each vibration member 621, 622, and 623 is designed to have a predetermined vibration frequency that matches the predetermined resonant frequency of the chamber 610. Thus, the group of vibration members in the vibration stack 620 vibrates substantially in unison in response to the bias means, resulting in an increased magnitude of the acoustic wave generated in the chamber 610. Each transducer in the group of transducers 630 senses the reciprocating deformation of a respective one of the vibration members in the vibration stack 620, and produces a voltage that is proportional to the reciprocating deformation. The voltage produced by each transducer is transferred to the electrical storage 130.

Figure 7:
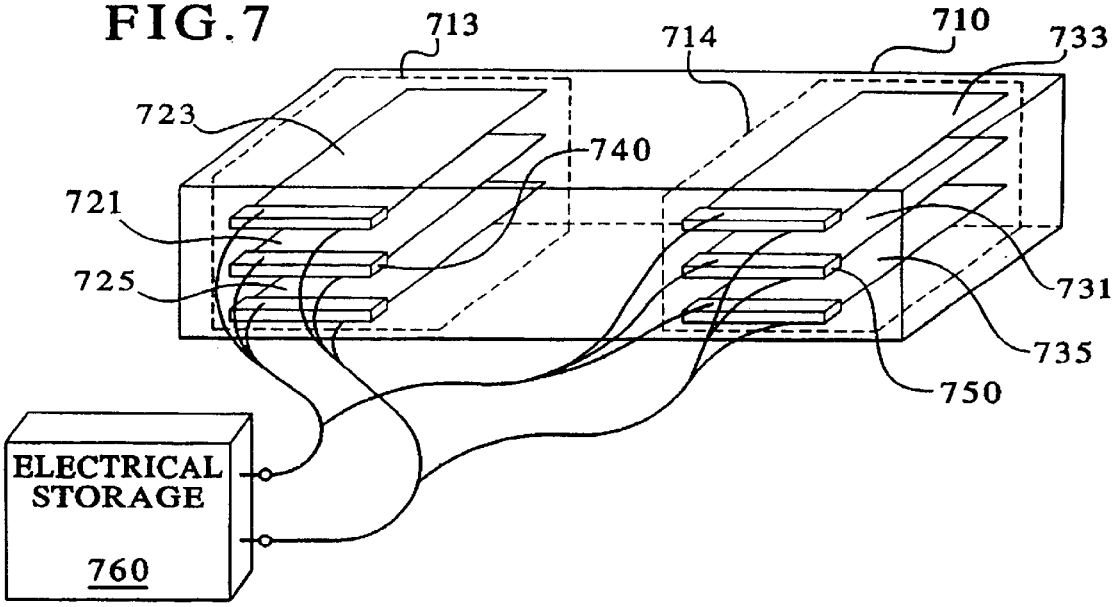
FIG. 7 depicts in perspective view two vibration stacks in a chamber another exemplary thermo-acoustic generator embodying principles of the present invention.

In yet another implementation depicted in FIG. 7, the thermo-acoustic generator 700 has a chamber 710, a first energy converter 713 that includes a first vibration member 721, and a second energy converter 714 that includes a second vibration member 731. The first and the second vibration members 721 and 731 are each electrically connected to a respective transducer 740 and 750. The transducers 740 and 750 are electrically connected to an electrical storage 760. In an alternative implementation, transducers 740 and 750 may be electrically connected to separate electrical storages (not shown). In addition, the first and second vibration members 721 and 731 each has a predetermined vibration frequency that matches the predetermined resonant frequency of the chamber 710 Both the first and second vibration members 721 and 731 are adapted to vibrate in response to the bias means in accordance with the present invention.

Figure 8:
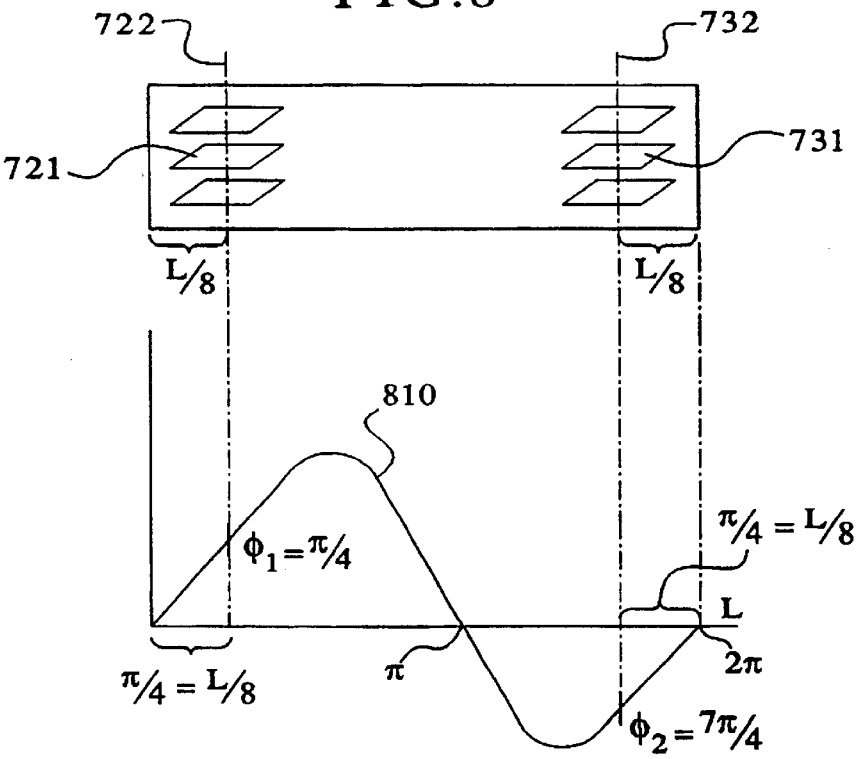
FIG. 8 depicts a cross sectional view of the thermo-acoustic generator in FIG. 7 in association with a graph form of an exemplary standing acoustic wave generated by the thermo-acoustic generator in FIG. 7

FIG. 8 illustrates a first position of the first vibration member 721 and a second position of the first vibration member 731 in relation to an acoustic cycle 800 of a standing acoustic wave 810. The standing acoustic wave 810 may be characterized as $P=\alpha\sin(\omega t+\Phi)$, where P is an instantaneous pressure within the chamber 710, $\alpha$ is a pressure constant of the standing acoustic wave 810, $\omega$ is the predetermined resonant frequency of the chamber in radians, t is time in seconds, and $\Phi$ is a phase delay in the acoustic cycle in radians. As shown in FIG. 8, the first vibration member 721 and the second vibration member 731 are disposed equidistant from opposing ends of the chamber 710 to produce the standing acoustic wave 810 in the chamber 710 when vibrating in response to the bias means. By being equidistant from opposing ends of the chamber 710, the first vibration member 721 operates at a first phase, $\Phi_1$, in the acoustic cycle 800 of the standing acoustic wave 810 and the second vibration member 731 operates at a second phase, $\Phi_2$, in the acoustic cycle 800 of the standing acoustic wave 810. In a this implementation, the first vibration member 721 operates at the first phase, $\Phi_1$, equal to $\pi/4$ or 45° phase delay of the acoustic cycle 800, and the second vibration member 721 operates at the second phase, $\Phi_2$, equal to $7\pi/4$ or 315° phase delay of the acoustic cycle 800 (i.e., $\Phi_{2=\pi/}4$ from end of the acoustic cycle 800). Thus, the first and second vibration members 721 and 731 each have a respective center axis 722 and 732 that are disposed a distance of ⅛ the resonate length of the chamber 710 from a respective opposing end of the chamber 710 (i.e., $L=2\pi$ so distance from opposing end$=L/8=2\pi/8=\pi/4$. When the thermo-acoustic generator 710 is operating in this implementation, the first and second vibration members 721 and 731 vibrate without producing significant harmonics that may attenuate or create a phase shift in the standing acoustic wave 810. Attenuation of the standing acoustic wave 810 reduces the acoustic energy that the transducers 740 and 750 may sense to produce electrical energy from the heat received through the first location 712 of the chamber 710, resulting in a less efficient production of electrical energy from the heat. A phase shift in the standing acoustic wave 810 may limit the transfer of the remaining heat to the second location 714 by the standing acoustic wave 810, resulting in a less efficient dissipation of the remaining heat away from the heat source and out to ambient air.

Returning to FIG. 7, the first and second vibration members 721 and 731 may also be one of a group of vibration members (721, 723, and 725, and 731, 733, and 735) in a respective vibration stack 720 and 730. Each of the vibration members in the vibration stacks 720 and 730 are electrically connected to a respective one of a group of transducers (740, 742, 744, and 750, 752, 754). The group of transducers are electrically connected to the electrical storage 760. In response to first pressure change in the chamber 710 and the second pressure change in the chamber 710, the group of vibration members in the vibration stack 720 and the group of vibration members in the vibration stack 730 operate to convert more heat to acoustical energy (i.e., produce a standing acoustic wave that has a higher magnitude or peak pressure). Thus, the group of transducers (740, 742, 744, 750, 752, 754) operate to produce more electrical energy from the acoustic energy. In this implementation, if one or more vibration members in one of the vibration stacks 720 and 730 fail to operate or one or more of the group of transducers (740, 742, 744, 750, 752, 754) fail to operate, the thermo-acoustic generator 700 will advantageously continue to produce electrical energy from heat and dissipate remaining heat.

Figure 9A:
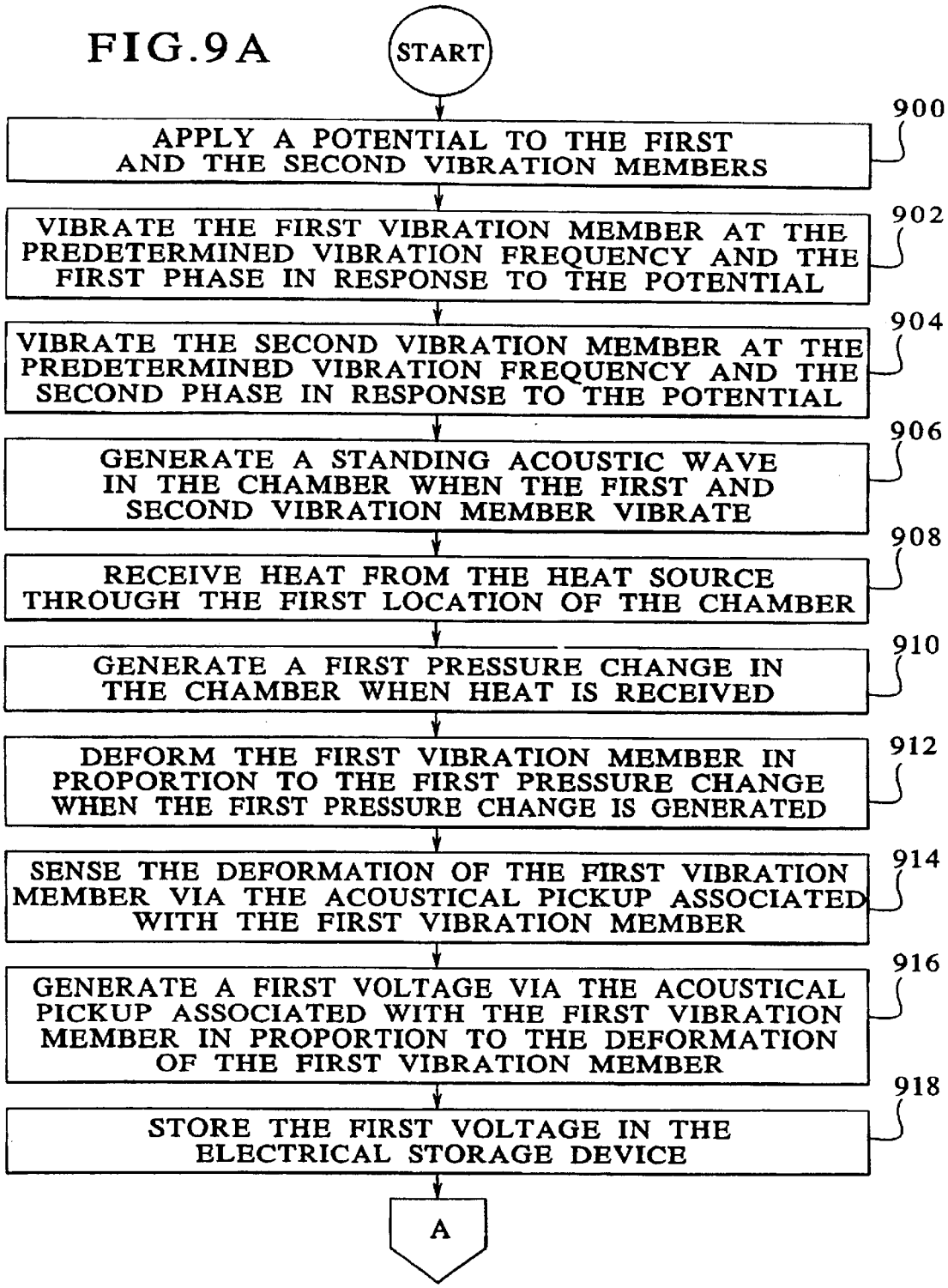
FIGS. 9A–B is a flowchart depicting an exemplary process for producing electrical energy from heat and dissipating remaining heat in the ambient in accordance with the invention.
Figure 9B:
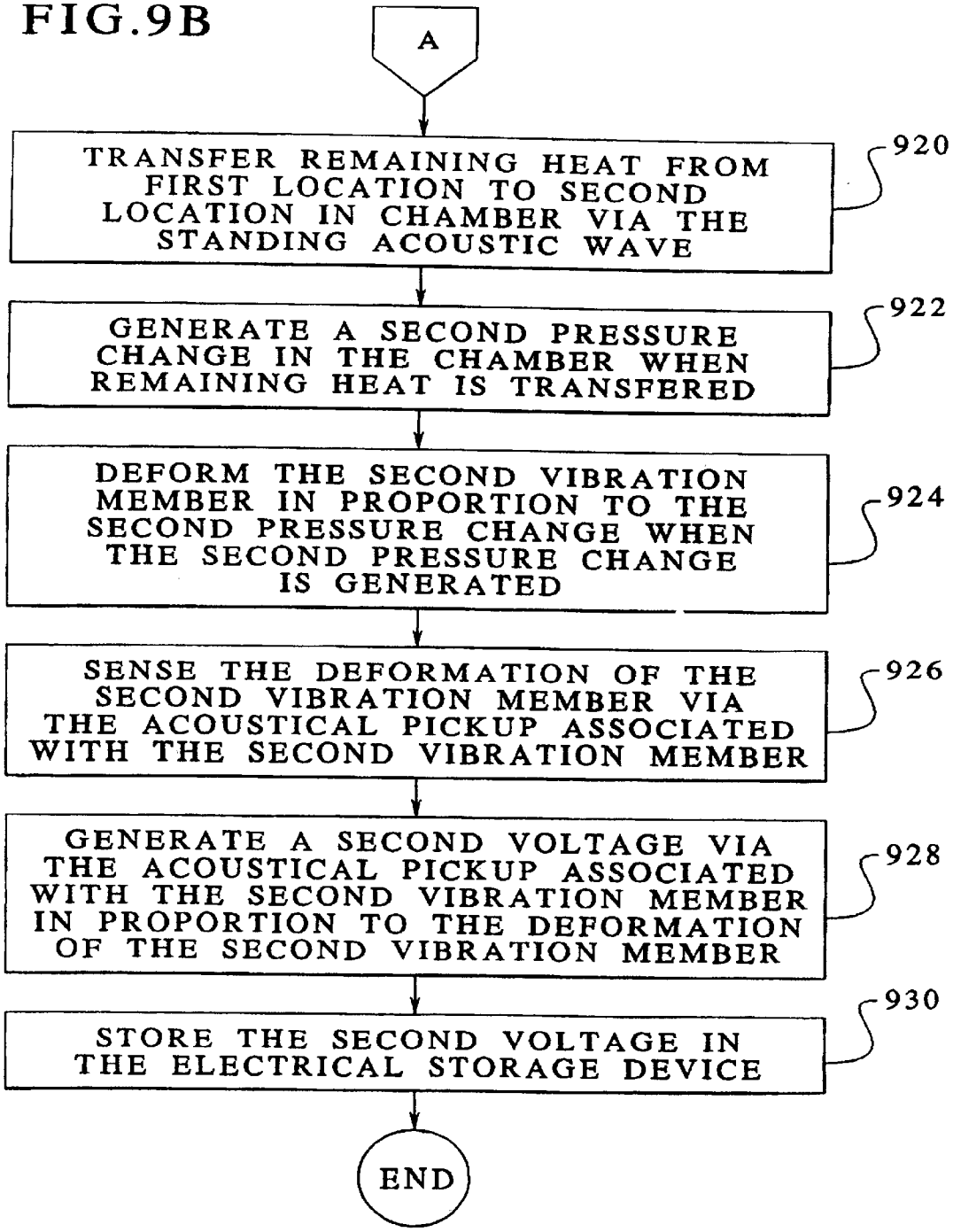

In FIG. 9, a flowchart of an exemplary process for producing electrical energy from heat received from heat source 152, and dissipating remaining heat to the ambient in accordance with the present invention is shown. An electrical potential is applied to the first and second vibration members 721 and 731 disposed within the chamber 710 of the thermo-acoustic generator 700 to bias the first and second vibration members 721 and 731 in a step 900, FIG. 9. The power supply 270 may provide the electrical potential upon the momentary closure of switch 272. The first vibration member 721 vibrates at the predetermined vibration frequency and the first phase in response to the potential in a step 902. The second vibration member 731 vibrates at the predetermined vibration frequency and the second phase in response to the potential in a step 904. To limit the production of a harmonic of the predetermined vibration frequency in the chamber 710, the first and second vibration members 721 and 731 vibrate at the predetermined vibration frequency that matches the predetermined resonant frequency of the chamber 710. When the first and second vibration members 721 and 731 vibrate, the standing acoustic wave 810 is produced in the chamber 710 in a step 906.

Heat is received from heat source 152 through the first location 712 of the chamber 710 in a step 908. In response to receiving heat through the first location 712, a first pressure change associated with the transfer of heat by the standing acoustic wave is produced in the chamber 710 in proximity to the first location 712 in a step 910. In a step 912, the first vibration member deforms in response to the first pressure change. The transducer 740 associated with the first vibration member senses the deformation of the first vibration member in a step 914. Next, in a step 916, the transducer 740 produces a first voltage in proportion to the deformation of the first vibration member 721. The first voltage is stored in the electrical storage 130 that is electrically connected to the transducer 740 in a step 918.

The remaining heat that is not converted to acoustical energy by the first vibration member 721 is transferred from the first location 712 to the second location 714 in chamber 710 by the standing acoustic wave 810 in a step 920. A second pressure change in the chamber 710 is produced in a step 922 when the remaining heat is transferred to the second location 714 to be dissipated out to the ambient. When the second pressure change is produced, the second vibration member 731 is deformed in response to the second pressure change in a step 924. The transducer 750 associated with the second vibration member 741 senses the deformation of the second vibration member 741 in a step 926. The transducer 750 then produces a second voltage in proportion to the deformation of the second vibration member 731 in a step 928. In addition to the first voltage, the second voltage is stored in the electrical storage 130 that is electrically connected to the transducer 750 in a step 930.

Although the foregoing detailed description of the present invention has been described by reference to various embodiments, and the best mode contemplated for carrying out the prevention invention has been herein shown and described, it will be understood that modifications or variations in the structure and arrangement of these embodiments other than there specifically set forth herein may be achieved by those skilled in the art and that such modifications are to be considered as being within the overall scope of the present invention. Accordingly, the means for conducting, the means for connecting, the means for generating electricity and the means for differentiating are meant to include not only the structures described herein, but also, any acts or materials described herein, and also include any equivalent structures, equivalent acts, or equivalent materials to those described therein.

What is claimed is:

1. A apparatus to produce electrical energy from heat, the apparatus comprising:

a chamber defining a closed system, the chamber having a first location adapted to receive heat, a second location adapted to dissipate heat, and an interior surface;

a fluid disposed within the chamber;

a first vibration member having a first end and a second end, with each end coupled to the interior surface of the chamber; and a transducer operably coupled to the first vibration member.

2. The apparatus of claim 1, wherein the chamber has a resonant length and a predetermined resonant frequency.

3. The apparatus of claim 1, wherein the chamber has two opposing ends, and the first and second locations of the chamber are each adjacent to a respective one of the two opposing ends of the chamber.

4. The apparatus of claim 1, wherein the first location of the chamber is adjacent to a heat source that is thermally connected to the chamber.

5. The apparatus of claim 4, wherein the first location of the chamber has an area that is the same size as and is aligned with a surface of the heat source.

6. The apparatus of claim 1 further comprising a means for drawing the heat from the chamber.

7. The apparatus of claim 6, wherein the means for drawing the heat from the chamber is adjacent to the second location of the chamber.

8. The apparatus of claim 7, wherein the means for drawing heat is a heat exchanger.

9. The apparatus of claim 1, wherein the chamber has a first wall portion associated with the first location, a second wall portion associated with the second location, and a third wall portion defined by the interior surface of the chamber exclusive of the first and second locations.

10. The apparatus of claim 9, wherein the first and second wall portions comprise conductive material.

11. The apparatus of claim 9, wherein the third wall portion comprises an insulation material.

12. The apparatus of claim 9, wherein the third wall portion is substantially covered with an insulating material.

13. The apparatus of claim 1, wherein the fluid is a gas that remains in a gaseous state at room temperature and at room pressure.

14. The apparatus of claim 1, wherein the fluid is a liquid that remains in a liquid state at room temperature and at room pressure.

15. The apparatus of claim 1, wherein the first vibration member is adapted to vibrate in response to an electrical potential applied to the first vibration member.

16. The apparatus of claim 1, wherein the first vibration member is adapted to vibrate in response to a pressure change in the fluid.

17. The apparatus of claim 2, wherein the first vibration member is adapted to vibrate at a predetermined vibration frequency that is substantially equal to the predetermined resonant frequency of the chamber.

18. The apparatus of claim 17, wherein the first vibration member is disposed in proximity to an end of the chamber.

19. The apparatus of claim 1, wherein the transducer is adapted to generate electricity from the vibration of the first vibration member.

20. The apparatus of claim 19 further comprising an electrical storage that is electrically connected to the transducer.

21. The apparatus of claim 1 further comprising a power supply electrically connected to the first vibration member.

22. The apparatus of claim 21 further comprising a switch operably disposed between the power supply and the first vibration member.

23. The apparatus of claim 1, wherein the first vibration member is one of a first plurality of vibration members.

24. The apparatus of claim 23, wherein the first plurality of vibration members are in a first stack.

25. The apparatus of claim 24 further comprising a plurality of electrical storages, a respective one of the plurality of electrical storages is coupled to a respective one of the first plurality of vibration members.

26. The apparatus of claim 2 further comprising a second vibration member having a first end and a second end, each end coupled to the interior surface of the chamber.

27. The apparatus of claim 26, wherein the first vibration member and the second vibration member are disposed equidistant from opposing ends of the chamber.

28. The apparatus of claim 27, wherein the first and second vibration members are each adapted to vibrate in response to a pressure change in the fluid and to a potential applied to the respective vibration member.

29. The apparatus of claim 28, wherein the first and second vibration members are each adapted to vibrate at the predetermined resonant frequency of the chamber to produce a standing acoustic wave that extends the resonant length of the chamber.

30. The apparatus of claim 29, wherein the first and second vibration members are each disposed within the chamber at a respective first and second position that corresponds to a respective first and second phase delay of a cycle of the standing acoustic wave.

31. The apparatus of claim 30, wherein the first phase is equal to $\pi/4$ phase delay of a cycle of the standing acoustic wave, and the second phase is equal to $7\pi/4$ phase delay of the standing acoustic wave.

32. The apparatus of claim 31 further comprising a second transducer that is coupled to the second vibration member and adapted to generate electricity from the vibration of the second vibration member.

33. The apparatus of claim 32, wherein the second transducer is electrically connected to the electrical storage.

34. The apparatus of claim 32, wherein the second transducer is electrically connected to the power supply.

35. A method for producing electrical energy from heat, the method comprising:

generating a standing acoustical wave in a chamber having a predetermined resonant frequency in response to the vibration of a first and a second vibration member disposed equidistant from opposing ends of the chamber;

receiving heat through a first location of the chamber, generating in proximity of the first location a first pressure change associated with the transfer of a first portion of the received heat by the standing acoustic wave in the chamber;

vibrating a first vibration member disposed within the chamber in response to the first pressure change; and generating a first voltage in response to the vibration of the first vibration member.

36. The method of claim 35, wherein the step of generating a first voltage includes the step of sensing a deformation of the first vibration member via a first transducer operably coupled to the first vibration member.

37. The method of claim 35, wherein the first voltage that is generated is proportional to the deformation of the first vibration member.

38. The method of claim 35 further comprising storing the first voltage in a electrical storage.

39. The method of claim 35 further comprising:

generating in proximity of the second location a second pressure change associated with the transfer of a second portion of the received heat by the standing acoustic wave in the chamber;

vibrating a second vibration member disposed within the chamber in response to the second pressure change;

generating a second voltage in response to the vibration of the second vibration member; and dissipating a third portion of the heat transferred via the standing acoustic wave at a second location within the chamber.

40. The method of claim 39, wherein the step of generating a second voltage includes the step of sensing a deformation of the second vibration member via a second transducer operably coupled to the second vibration member.

41. The method of claim 40, wherein the second voltage that is generated is proportional to the deformation of the second vibration member.

42. The method of claim 35 further comprising applying a potential to the first and the second vibration members to bias the first and the second vibration members to vibrate.

43. The method of claim 39, wherein the third portion of the heat transferred is dissipated to the ambient through the second location.

* * * * *